US005728031A

United States Patent [19]

Honeycutt

[11] Patent Number: 5,728,031

[45] Date of Patent: Mar. 17, 1998

[54] IMPACT EXERCISE APPARATUS

[75] Inventor: W. C. Honeycutt, Worcester, Mass.

[73] Assignee: W. C. Honeycutt, Inc., Worcester, Mass.

[21] Appl. No.: 674,754

[22] Filed: Jul. 2, 1996

[51] Int. Cl.[6] ..... A63B 69/20; A63B 69/00

[52] U.S. Cl. ..... 482/83; 482/86; 482/87; 482/90; 482/148

[58] Field of Search ..... 482/83, 85, 86, 482/87, 88, 89, 90; 273/58 C, 58 H, 58 B, 58 BA; 601/107

[56] References Cited

U.S. PATENT DOCUMENTS

| | | | |
|---|---|---|---|
| 788,433 | 4/1905 | Shand . | |
| 825,860 | 7/1906 | McKenzie | 482/86 X |
| 2,218,919 | 10/1940 | Madsen . | |
| 2,253,758 | 8/1941 | Bulloch | 482/83 X |
| 2,620,188 | 12/1952 | Malagio | 482/90 X |
| 3,724,845 | 4/1973 | Irby | 482/83 |
| 4,257,589 | 3/1981 | Outlaw | 482/83 |
| 4,462,590 | 7/1984 | Mitchell . | |
| 4,738,450 | 4/1988 | Wexler . | |
| 4,834,382 | 5/1989 | Spector . | |
| 4,917,381 | 4/1990 | Spector . | |
| 5,286,020 | 2/1994 | Caruso . | |
| 5,389,057 | 2/1995 | Zagata, Jr. | 482/83 |
| 5,554,088 | 9/1996 | Zlojutro | 482/83 |

*Primary Examiner*—Richard J. Apley
*Assistant Examiner*—William LaMarca
*Attorney, Agent, or Firm*—Blodgett & Blodgett, P.C.

[57] ABSTRACT

An exercise apparatus for use in developing abdominal muscle. The exercise apparatus includes a supporting structure adjustably mounted on a platform and a lever structure mounted on the upper end of the supporting structure for pivoting about a horizontal axis. The lever structure has a first arm which is connected to a handle and a second arm which supports an impact member such as a medicine ball. The exercise apparatus is used by an individual by standing on the platform and pulling the handle toward his or her chest. The individual then pushes the handle away from his or her chest which causes the impact member to swing toward the individual's abdomen. The supporting structure is adjustable so that the impact member can be positioned to strike the abdomen of individuals of different height.

4 Claims, 5 Drawing Sheets

IMPACT EXERCISE APPARATUS

STATEMENT REGARDING FEDERALLY SPONSORED RESEARCH OR DEVELOPMENT

This invention has been created without the sponsorship or funding of any federally sponsored research or development program.

CROSS-REFERENCE TO RELATED APPLICATIONS

Not applicable

BACKGROUND OF THE INVENTION

1. Field of the Invention

The present invention is directed to an exercise device for strengthening and hardening abdominal muscles.

2. Description of the Prior Art

Although many machines have been developed for strengthening abdominal muscles, the tossing of a medicine ball remains the preferred effective form of exercise for this function. However, there are many disadvantages connected with the use of a medicine ball. One of the main disadvantages of the medicine ball is that it requires two people. The medicine ball must be thrown by a first person toward the abdomen of the other. Another disadvantage of the medicine ball is that it is difficult for the medicine ball to be thrown accurately. The ball may be thrown too low or off to the right or left of the abdomen. Finally, the medicine ball may be thrown too hard or not hard enough. An errant throw of the medicine ball can cause injury to the person receiving the throw or the person receiving the throw is not likely to obtain optimum exercise benefits due to irregular and inaccurate throws of the medicine ball.

BRIEF SUMMARY OF THE INVENTION

An exercise apparatus for use in developing abdominal muscle. The exercise apparatus includes a supporting structure adjustably mounted on a platform and a lever structure mounted on the upper end of the supporting structure for pivoting about a horizontal axis. The lever structure includes a first arm which is connected to a handle and a second arm which supports an impact member such as a medicine ball. The exercise apparatus is used by an individual by standing on the platform and pulling the handle toward the for his or her chest. The individual then pushes the handle away from his or her chest which causes the impact member to swing toward the individual's abdomen. The supporting structure is adjustable so that the impact member can be positioned to strike the abdomen of the individuals of different height.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
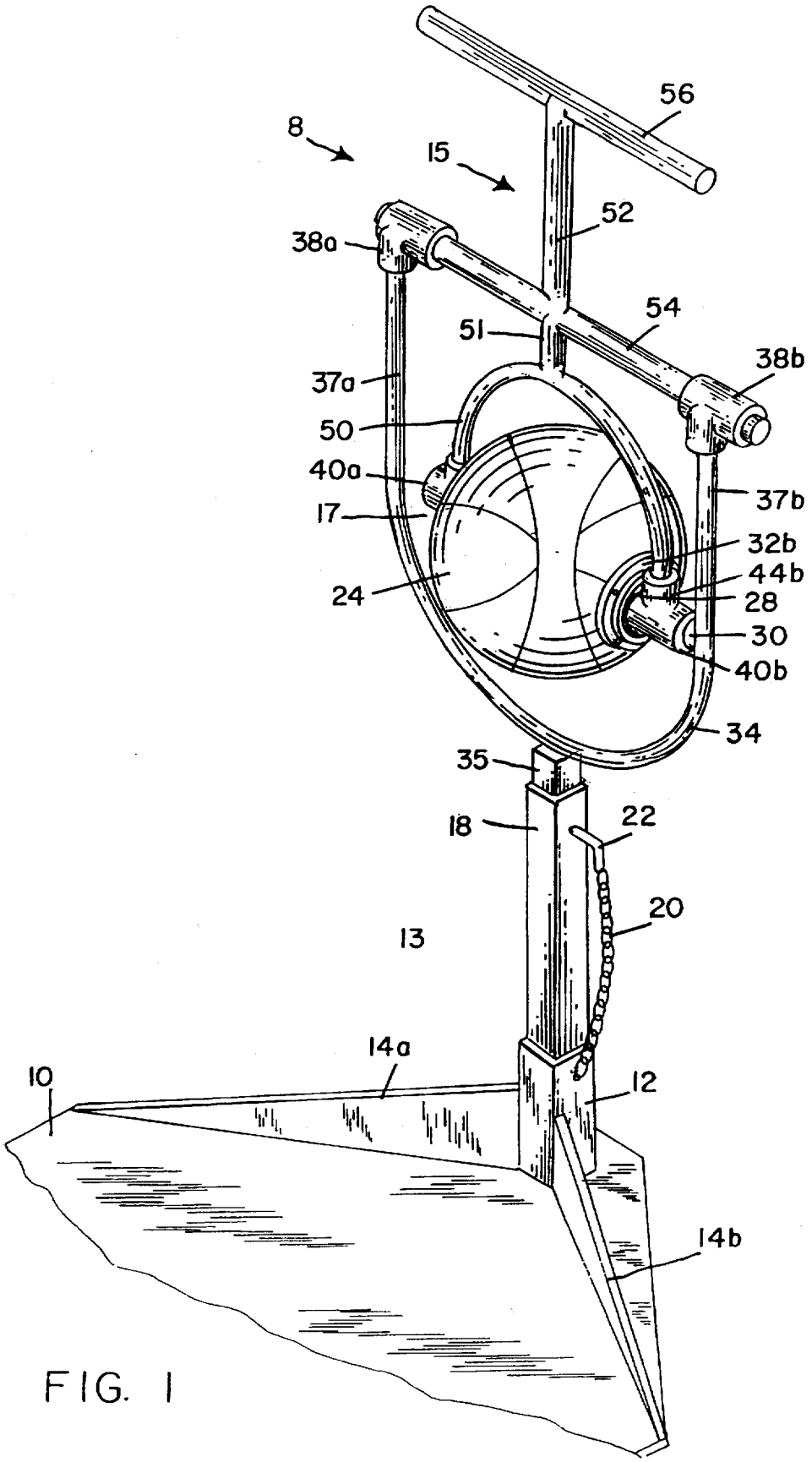
FIG. 1 is an isometric view of the exercise apparatus of the present invention.
Figure 2:
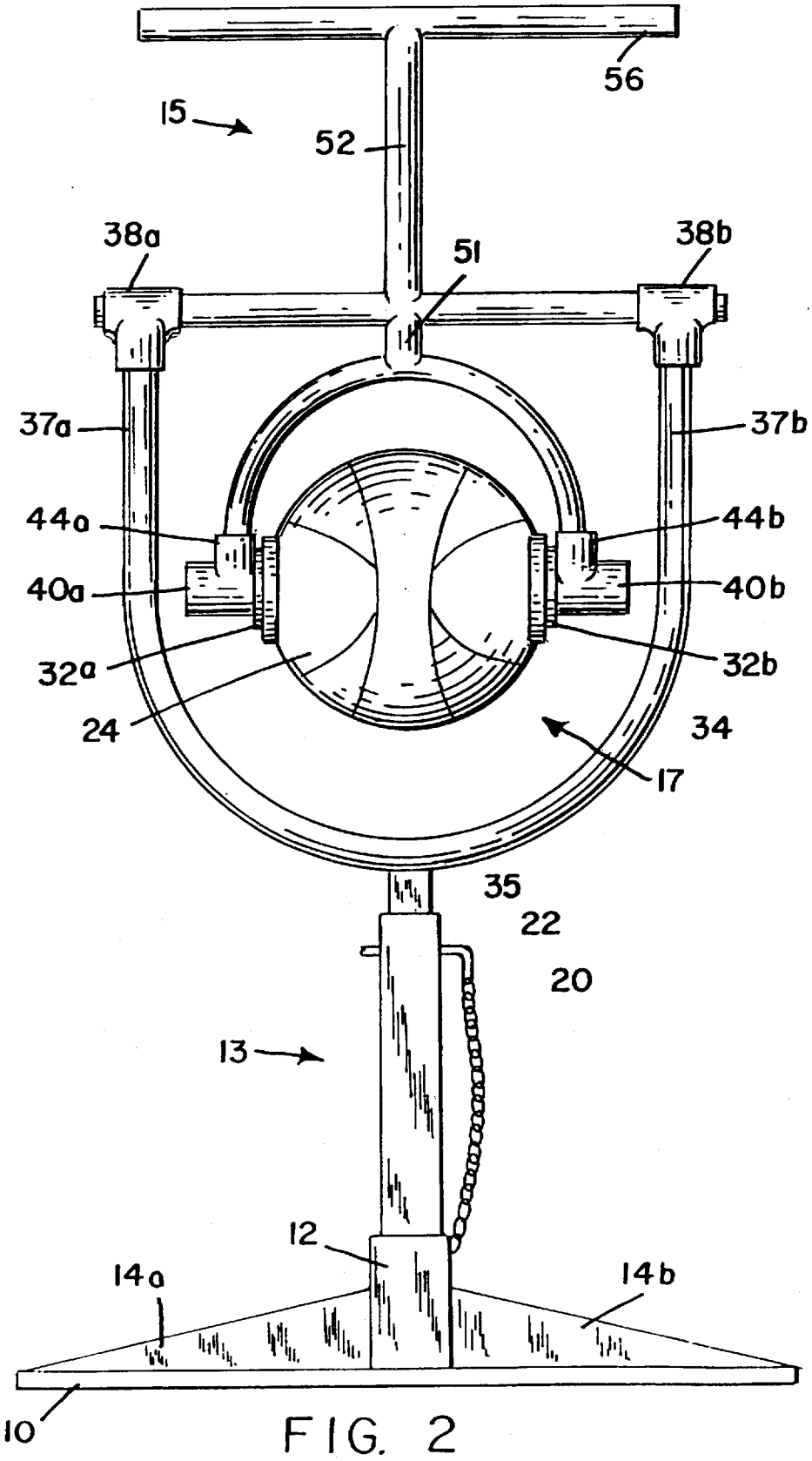
FIG. 2 is front elevational view of the exercise apparatus of FIG. 1.

Referring first to FIGS. 1 and 2, the exercise apparatus of the present invention is generally indicated by the reference numeral 8 and comprises a platform 10, an adjustable supporting structure, generally indicated by the reference numeral 13, mounted on the platform 10, and a lever structure, generally indicated by the reference numeral 15, pivotally mounted on the upper end of the supporting structure 13. The lever structure 15 has a first arm portion 51 for supporting an impact member, generally indicated by the reference numeral 17, and a second arm 52 for supporting a handle 56.

Referring particularly to FIGS. 1–4, the platform 10 has a vertically extending base pipe or tube 12 fixed to the upper surface of the platform and buttressed by flanges **14*a* and 14*b*. A rubber mat 16** is fixed to the under surface of the platform.

Figure 5:
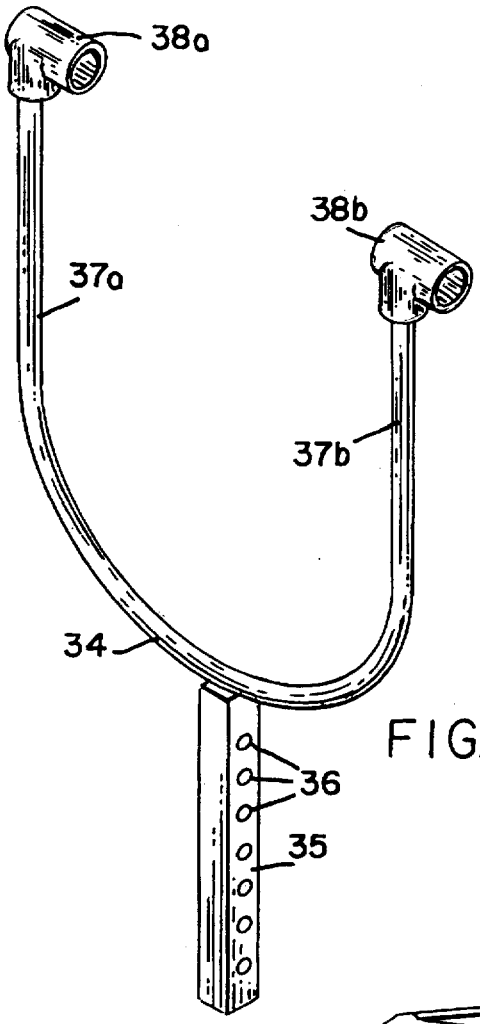
FIG. 5 is an isometric view of the upper portion of the supporting structure for the impact member.
Figure 4:
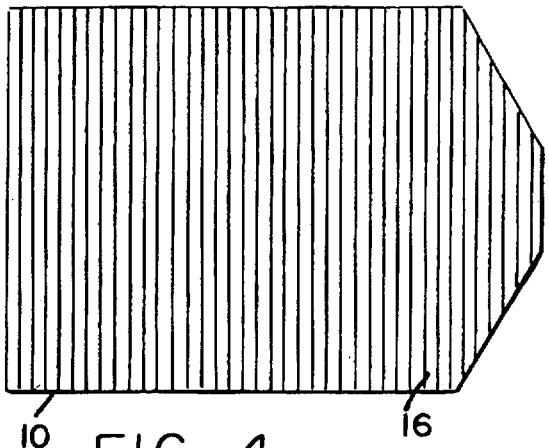
FIG. 4 is a bottom plan view of the platform.
Figure 3:
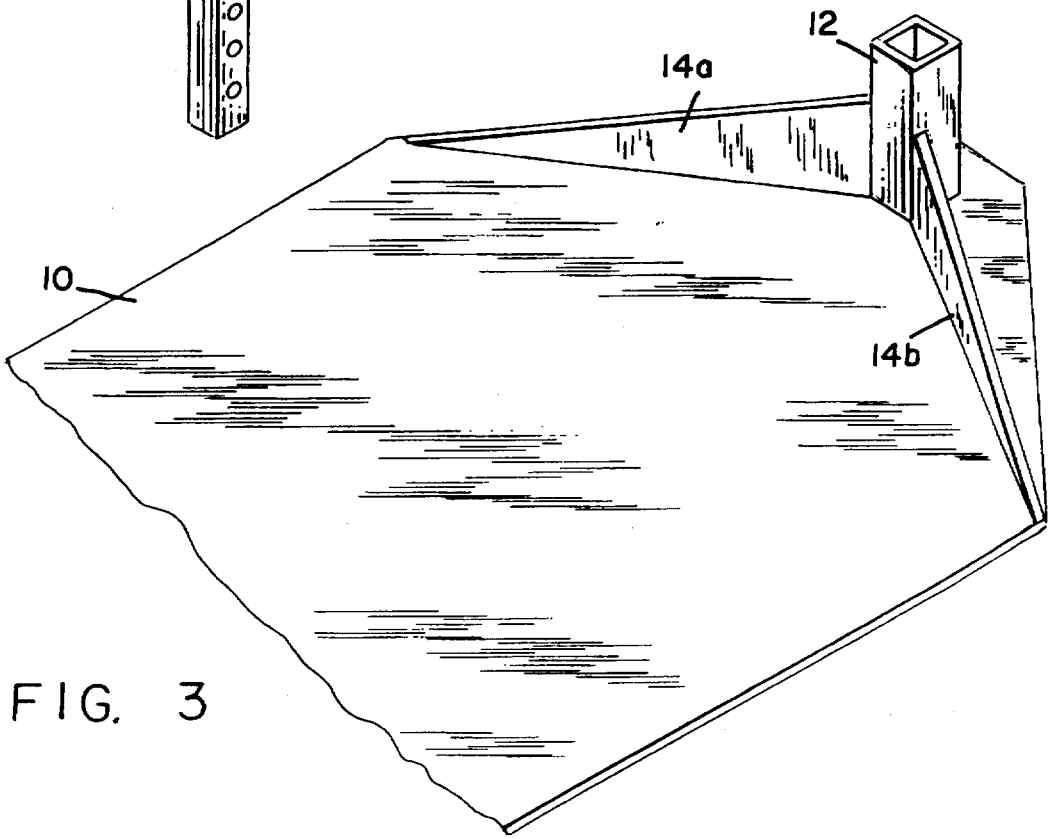
FIG. 3 is an isometric view of the platform portion of the exercise apparatus.
Figure 6:
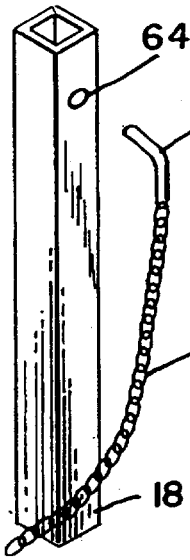
FIG. 6 is an isometric view of the lower portion of the supporting structure for the impact member.
Figure 7:
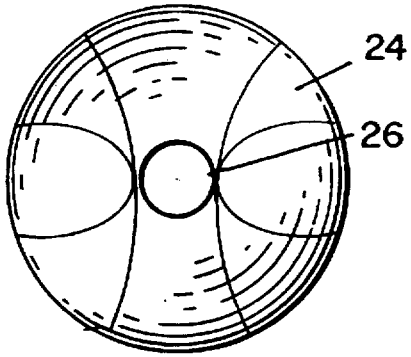
FIG. 7 is an elevational view of a medicine ball which forms part of the impact member.
Figure 8:
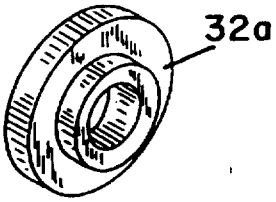
FIG. 8 is an isometric view of a first flange which forms part of the impact member.
Figure 9:
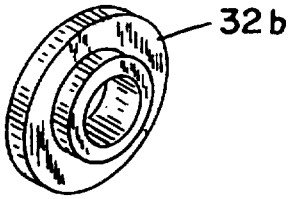
FIG. 9 is an isometric view of a second flange which forms part of the impact member.
Figure 10:
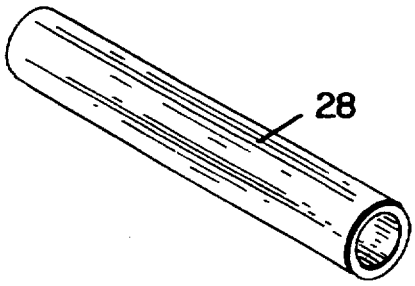
FIG. 10 is an isometric view of a sleeve portion of the impact member.
Figure 11:
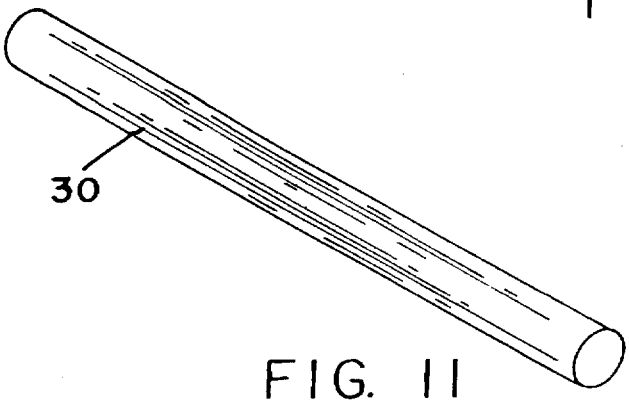
FIG. 11 is an isometric view of a shaft portion of the impact member.

Referring to FIGS. 1, 5, and 6, the supporting structure 15 includes a vertical outer pipe or tube 18 which is removably insertable into the base tube 12 and an adjustable U-bar 34. The U-bar 34 has an vertical inner tube 35 which is insertable within the tube 18 and a pair of upwardly extending vertical arms **37*a* and 37*b*. The vertical inner tube 35 has a plurality of apertures 36. The vertical outer tube 18 has an aperture 64. A locking pin 22 is connected to the outer tube 18 by a chain 20. When the inner tube 35 is inserted into the outer tube 18, the aperture 64 is capable of being aligned with any of the apertures 36 so that when the tube 35 is in a desired vertical position relative to the tube 18, the aperture 64 is horizontally aligned with one of the apertures 36. The locking pin 22 is inserted through the aperture 64 and the corresponding aperture 36 to maintain the inner tube 35 in its adjusted vertical position. The T-shaped bar holders 38*a* and 38*b* are fixed to the upper ends of the vertical arms 37*a* and 37*b***, respectively.

Figure 12:
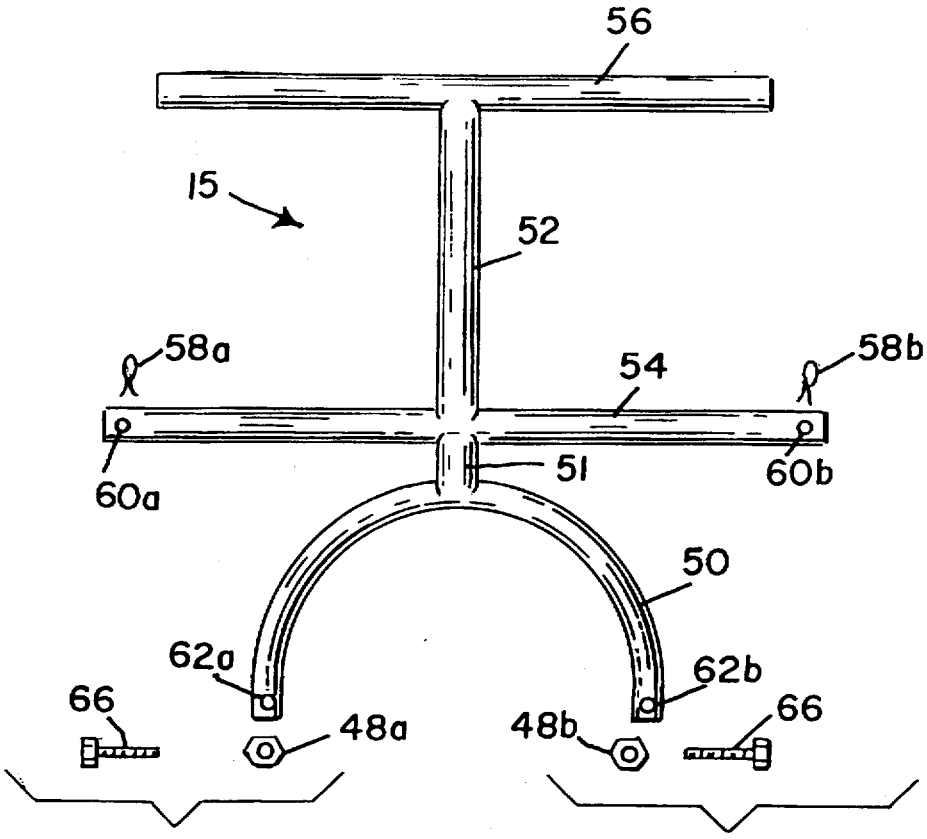
FIG. 12 is a front elevation view of the lever structure portion of the exercise apparatus.
Figure 13:
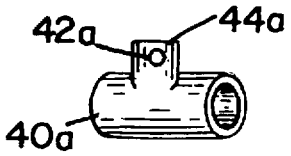
FIG. 13 is an isometric view of a T-joint which forms part of the lever structure.
Figure 14:
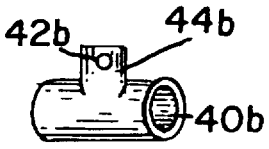
FIG. 14 is an isometric view of a second T-joint which forms part of the lever structure.

Referring to FIGS. 12–14, the lever structure 15 includes a pivoting bar 54 which is located between the first arm portion 51 and the second arm portion 52. The ends of the pivoting bar 54 extend through the bar holders **38*a* and 38*b* so that a portion of each end of the bar extends beyond the bar holders. The ends of the pivoting bar 54 are provided with holes 60*a* and 60*b* for receiving pins 58*a* and 58*b*, respectively. This retains the pivoting bar 54 in position on the bar holders 38*a* and 38*b*. A curved bar 50 which has a bifurcated lower end is fixed to the lower end of the first arm portion 51. The lower ends of the curved bar 50, indicated by the reference numerals 61***a* and 61*b*, have apertures 62*a* and 62*b*, respectively. Aperture 62*a* and 62*b* are adapted to receive bolts 66 which in turn are adapted to receive nuts 48.

Referring to FIGS. 1, 2 and 7–11, the impact members 17 includes a conventional medicine ball 24 which is modified to contain a central hole 26 for receiving a sleeve 28. A solid pipe or shaft 30 extends through the sleeve 28. Flanges 32*a* and 32*b* are mounted on the outer ends of the shaft 30 and about the medicine ball 24. The ends of the shaft 30 extend into T-joints 40*a* and 40*b*, see FIGS. 13 and 14. The T-joints 40*a* and 40*b* have vertical upper portions 44*a* and 44*b*, respectively, for receiving the ends 61*a* and 61*b*, respectively, of the first arm portion 50. The vertical upper portions 44*a* and 44*b* have apertures 42*a* and 42*b*, respectively, which are aligned with apertures 62*a* and 62*b*, respectively, when the ends 61*a* and 61*b* are inserted into the vertical portions 44*a* and 44*b*, respectively. The T-joints 40*a* and 40*b* are secured to the ends 61*a* and 61*b*, respectively, by inserted bolts 66 through the aligned apertures of respective T-joints 40*a* and 40*b* and ends 61*a* and 61*b*, respectively, and applying nuts 48 to ends of the bolts 66.

The exercise device of the present invention is utilized by an individual in the following manner. First, the individual stands on the platform 10 facing the impact member 17. The weight of the individual helps to anchor the exercise device to the floor. The inner vertical tube 35 is adjusted relative to the tube 18 to a desired height, wherein the medicine ball 24 is horizontally aligned with the individuals abdomen. The desired height is maintained as previously described by inserting the locking pin 22 through the aligned holes in the tubes 35 and 18. The individual then grabs the handle 56 with both hands. The handle is drawn to the individuals chest, thereby swinging the medicine ball 24 away from the individual. The individual then pushes the handle 56 away from his or her chest which causes the medicine ball 24 to swing into the individuals abdomen. In this way, the medicine ball 24 will always strike the individual's abdomen at the same desired location. The individual can control the intensity of the impact by pushing the handle slowly or quickly as desired.

Clearly, minor changes may be made in the form in construction of this invention without departing from the material spirit thereof. Therefore, it is not desired to confine the invention to the exact form shown herein and described, but it is desired to include all subject matter that properly comes within the scoped claim.

The invention having been thus described, what is claimed is new and desired to secure by Letters Patent is:

1. An exercise apparatus for use in developing abdominal muscles, said exercise apparatus comprising:

(a) a platform;

(b) a supporting structure having a lower end attached to the platform and an upper end vertically spaced from the platform, the upper end of said supporting structure comprising a pair of vertical arms, said vertical arms having lower ends connected to the lower end of said supporting structure and spaced upper ends;

(c) a lever structure mounted on the upper end of the supporting structure, said lever structure comprising a horizontal bar which is pivotally connected to the upper ends of said vertical arms for pivoting about a horizontal axis, said lever structure having a first arm portion which extends from said horizontal axis in a first direction and a second arm portion which extends from said horizontal axis in a second direction;

(d) an impact member connected to said first arm portion so that said impact member is spaced from said horizontal axis and swings between said vertical arms, said impact member having a convex surface; and (e) a grasping handle connected to said second arm portion so that said grasping handle is spaced from said horizontal axis, said grasping handle and said impact member being orientated so that said impact member swings toward a person's torso when said person pushes said grasping handle away from said person's torso.

2. An exercise apparatus for use in developing abdominal muscles, said exercise apparatus comprising:

(a) a platform;

(b) a supporting structure having a lower end attached to the platform and an upper end vertically spaced from the platform;

(c) a lever structure mounted on the upper end of the supporting structure for pivoting about a horizontal axis, said lever structure having a first arm portion which extends from said horizontal axis in a first direction and a second arm portion which extends from said horizontal axis in a second direction, said first arm portion having a pair of spaced outer end portions;

(d) a horizontal shaft which is supported on said spaced outer end portions so that said shaft extends between said outer end portions;

(e) an impact member mounted on said shaft so that said impact member is spaced from said horizontal axis and located between said outer end portions, said impact member having a convex surface; and (f) a grasping handle connected to said second arm portion so that said grasping handle is spaced from said horizontal axis, said grasping handle and said impact member being orientated so that said impact member swings toward a person's torso when said person pushes said grasping handle away from said person's torso.

3. An exercise apparatus as recited in claim 2, wherein said impact member further comprises a sleeve between said medicine ball and said shaft.

4. An exercise apparatus for use in developing abdominal muscles, said exercise apparatus comprising:

(a) a platform;

(b) a supporting structure having a lower end attached to the platform and an upper end vertically spaced from the platform;

(c) a lever structure mounted on the upper end of the supporting structure for pivoting about a horizontal axis, said lever structure having a first and portion which extends from said horizontal axis in a first direction and a second arm portion which extends from said horizontal axis in a second direction, said first arm portion having a pair of spaced outer end portions;

(d) an impact member operatively connected to said outer end portions so that said impact member is spaced from said horizontal axis and located between said outer end portions, said impact member having a convex surface; and (e) a grasping handle connected to said second arm portion so that said grasping handle is spaced from said horizontal axis, said grasping handle and said impact member being orientated so that said impact member swings toward a person's torso when said person pushes said grasping handle away from said person's torso.

* * * * *